US007152355B2

(12) United States Patent
Fitzpatrick et al.

(10) Patent No.: US 7,152,355 B2
(45) Date of Patent: Dec. 26, 2006

(54) MODULAR GUNSTOCK

(76) Inventors: Richard M. Fitzpatrick, 6816 N. 95th St., Longmont, CO (US) 80504; Stephen Charles Hines, P.O. Box 423, Tijeras, NM (US) 87059

( * ) Notice: Subject to any disclaimer, the term of this patent is extended or adjusted under 35 U.S.C. 154(b) by 53 days.

(21) Appl. No.: 10/722,699

(22) Filed: Nov. 24, 2003

(65) Prior Publication Data

US 2006/0096146 A1 May 11, 2006

Related U.S. Application Data

(63) Continuation of application No. 10/180,429, filed on Jun. 25, 2002, now Pat. No. 6,651,371.

(51) Int. Cl.
*F41C 23/00* (2006.01)

(52) U.S. Cl. ..... 42/73; 42/72; 42/75.01

(58) Field of Classification Search ..... 42/71.01, 42/72, 73, 75.01, 75.03
See application file for complete search history.

(56) References Cited

U.S. PATENT DOCUMENTS 2,900,877 A 8/1959 McClenahan
3,137,958 A 6/1964 Lewis
3,267,601 A 8/1966 Roy
3,348,328 A 10/1967 Roy
3,442,042 A 5/1969 Gilbert
4,327,626 A 5/1982 McQueen
4,735,007 A 4/1988 Gal
5,173,564 A * 12/1992 Hammond, Jr. ..... 42/75.03
5,827,992 A 10/1998 Harris
6,481,143 B1 * 11/2002 McCarthy ..... 42/74

* cited by examiner

*Primary Examiner*—J. Woodrow Eldred
(74) *Attorney, Agent, or Firm*—Geoffrey E. Dobbin

(57) ABSTRACT

The present invention is a modular stock system for rifles. The system replaces the rifle's buffer tube with a modified one containing a mount for a constant cheek weld and a rail track for adjustment. A stock module then mounts on the replacement buffer tube. The stock module is interchangeable depending on the user's needs. Various configurations of the stock module are discussed, including adjustable stocks, fixed stocks, and specialized stocks. The stock module may be made even further modular by the addition of rail system.

6 Claims, 9 Drawing Sheets

MODULAR GUNSTOCK

CROSS-REFERENCE TO RELATED APPLICATIONS

This application is a continuation application based on earlier filed application Ser. No. 10/180,429, filed on Jun. 25, 2002, now U.S. Pat. No. 6,651,371, said Application hereby incorporated herein by reference.

FIELD OF INVENTION

The present invention relates to a rifle stock and more particularly related to a modular gunstock that provides a constant surface for a uniform cheek weld and the option of a variable length feature.

BACKGROUND OF THE INVENTION

Adjustable gunstocks are known in the prior art. For example, U.S. Pat. No. 4,735,007 to Gal (1988); U.S. Pat. No. 4,327,626 to McQueen (1982); U.S. Pat. No. 3,442,042 to Gilbert (1967); U.S. Pat. No. 3,348,328 to Roy (1966); U.S. Pat. No. 3,267,601 to Roy (1964); 3,137,958 to Lewis, et al. (1962); U.S. Pat. No. 5,827,992 to Harris, et al. (1998) and U.S. Pat. No. 2,900,877 to McClenahan (1956) are all illustrative of the prior art.

The current standard in automatic and semi-automatic rifles is to have a stock capable of receiving and covering a recoil absorption appendage, or "buffer tube", shown in the '992 and '877 patents. The most popular of the available adjustable stocks follow in form to the '328 patent, which is to say they use a spring loaded latch to bias a pin inside a provided adjustment hole. When a user wishes to adjust the stock, a simple compression of the spring/latch assembly is all that is required to release the pin and, therefore, adjust the stock. The '626 patent operates with a tooth-and-groove assembly which, otherwise, follows the same principles. In both cases, compression of the spring is necessary for adjustment in both directions along any length beyond the proximate hole/groove. All of the adjustable stocks may have their butt portion removed, though they are not designed to have such a feature repeatedly used, much less have additional stock modules to exchange. In those cases where the stock moves longitudinally along the weapon, with no other motion relative to the weapon, the user must make some sacrifice as to one, if not both, of two features. The user either loses constant and uniform cheek weld to the weapon or stock stability. The lack of uniform cheek weld can interfere with comfortable and precise use of the weapon. Stock stability can also interfere with precise weapon use.

While the aforementioned inventions accomplish their individual objectives, they do not describe a truly modular stock, namely a stock where the butt portion is designed to be changed at the whim or need of the user. Likewise, they do not describe a stock that utilizes a cam/tension lock that enables the user to have not only a controlled extension, but also an unrestricted and silent compression and extension of the stock. None of the disclosed stocks have an adjustable preset lock to use in conjunction with an unrestricted adjustment. Finally, none of the disclosed stocks present a surface for a constant cheek weld while simultaneously having a sturdy, longitudinal adjustment capable stock, much less a uniform cheek weld with different stock types. In this respect, the gunstock according to the present invention departs substantially from the usual designs in the prior art.

In doing so, this invention provides a modular gunstock allowing for a uniform and identical cheek weld for different stock modules, even while simultaneously adjusting the stock length of an adjustable stock.

SUMMARY OF THE INVENTION

In view of the foregoing disadvantages inherent in the known types of gunstocks, this invention provides an improved gunstock. As such, the present invention's general purpose is to provide a new and improved modular gunstock that will have multiple functionality, dependent upon chosen stock modules. The invention will provide simultaneous adjustment of the stock while providing a sturdy, uniform cheek weld on the stock when used with an adjustable stock module. The invention will also provide an identical cheek weld surface with a sturdy stock if a fixed stock is used.

To provide the improved features, the gunstock comprises both a fore and butt portion. The fore portion consists of a buffer tube attachable to the weapon's receiver and a cheek plate extension essentially parallel to the buffer tube. Located on the underside of the buffer tube is a rail track. The rear portion consists of a receiving cylinder of sufficient length and width to receive the buffer tube of the fore portion. Located on the lower rim of the cylinder is the compression latching mechanism, designed to interface with the rail track. Rearward of the receiving cylinder is the stock butt and any other accessories as required by the user. In the preferred embodiment, the cheek plate is fused to the buffer tube, presenting a wider rest for a user's cheek, and the rear portion comprises a receiving cradle, or semi-cylinder, which interfaces along a pair of attachment grooves located on either side of the buffer tube, having a distal relation with the cheek plate The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
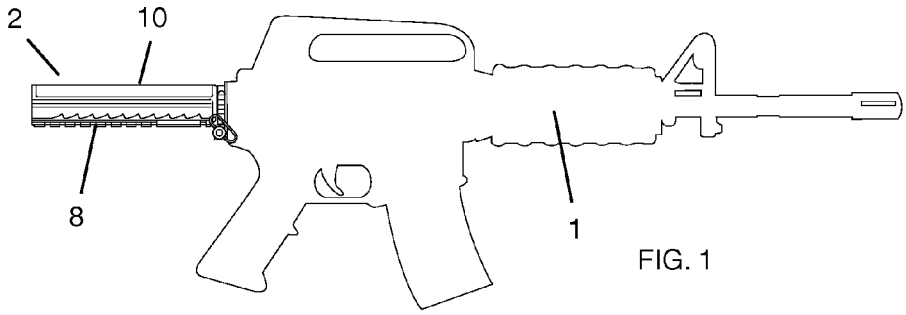
FIG. 1 is a side elevation of a rifle with the modified buffer tube according to the present invention.
Figure 1A:
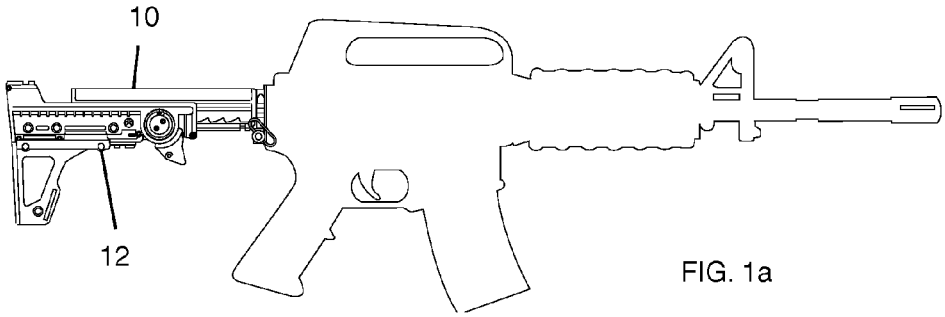
FIG. 1*a* is the rifle of FIG. 1 with an adjustable stock attachment.
Figure 1B:
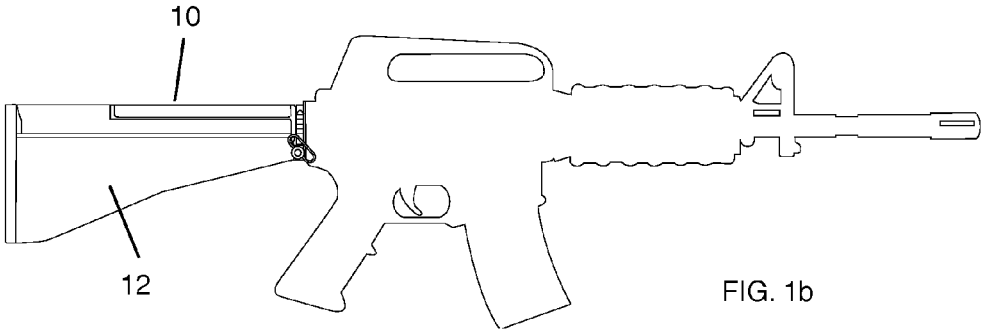
FIG. 1*b* is the rifle of FIG. 1 with a fixed stock attachment.
Figure 1C:
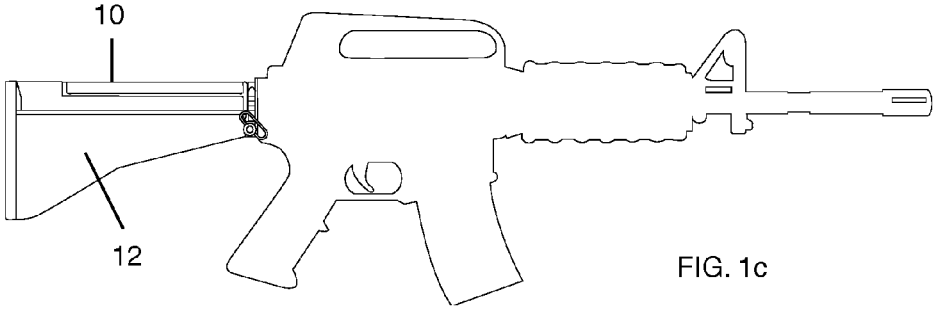
FIG. 1*c* is the rifle of FIG. 1 with a "shorty" fixed stock attachment
Figure 2:
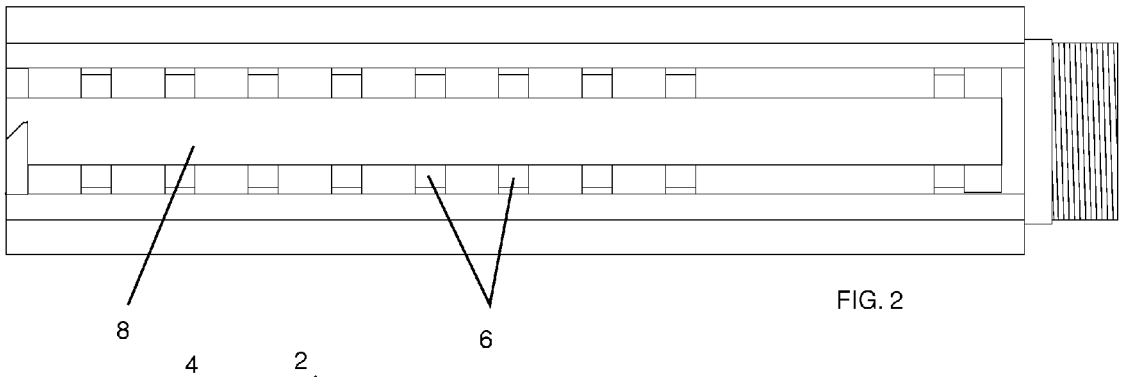
FIG. 2 is a bottom plan view of the modified buffer tube module.
Figure 3:
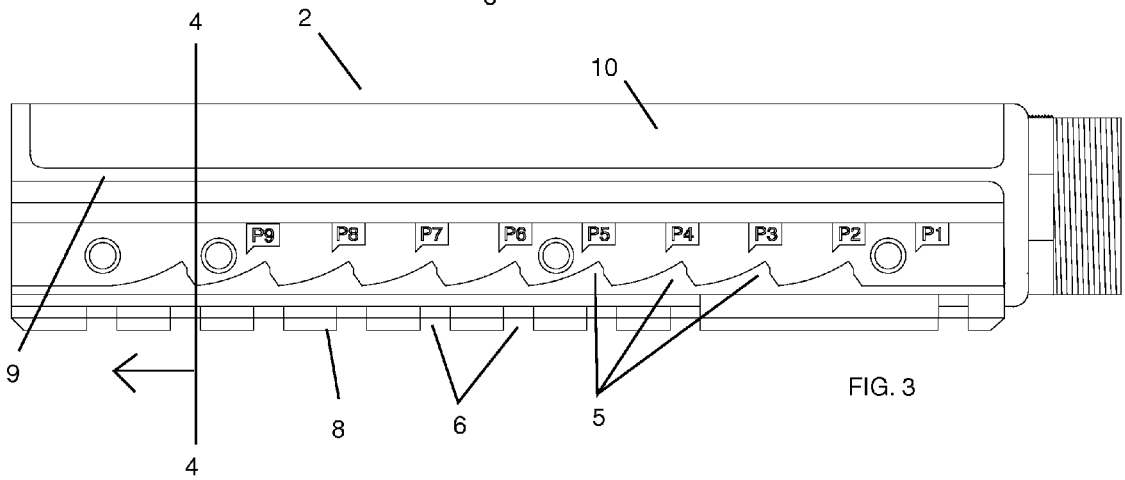
FIG. 3 is a side elevation of the modified buffer tube module.
Figure 4:
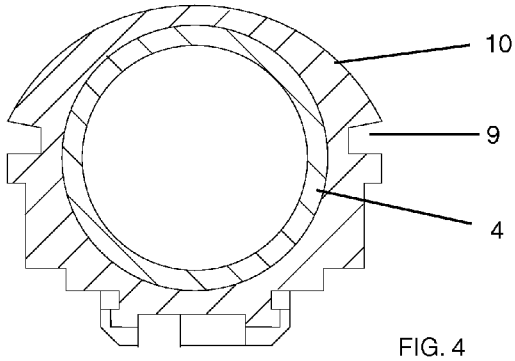
FIG. 4 is a cross section of the buffer tube module of FIG. 3 taken at line 4.
Figure 5A:
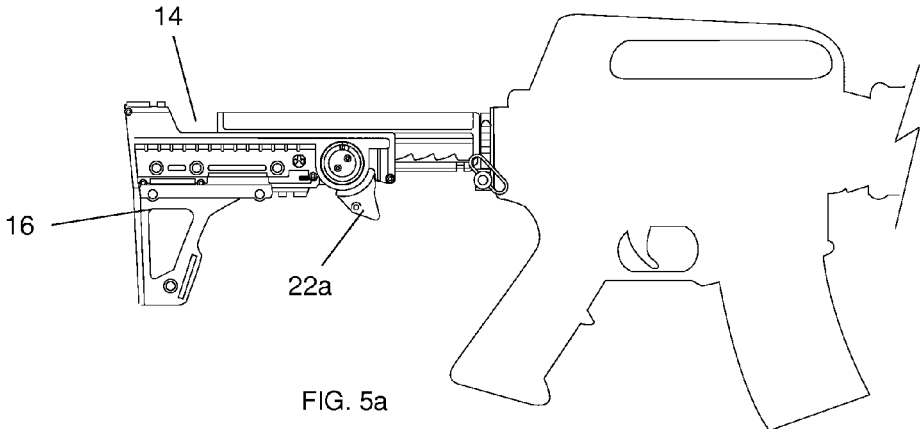
FIGS. 5*a*–5*c* are three successive side elevations showing the use of the adjustable stock embodiment.
Figure 5B:
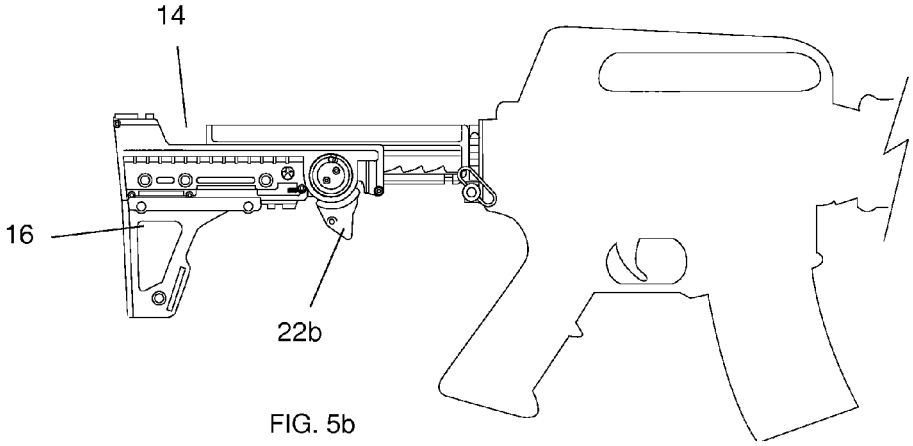
Figure 5C:
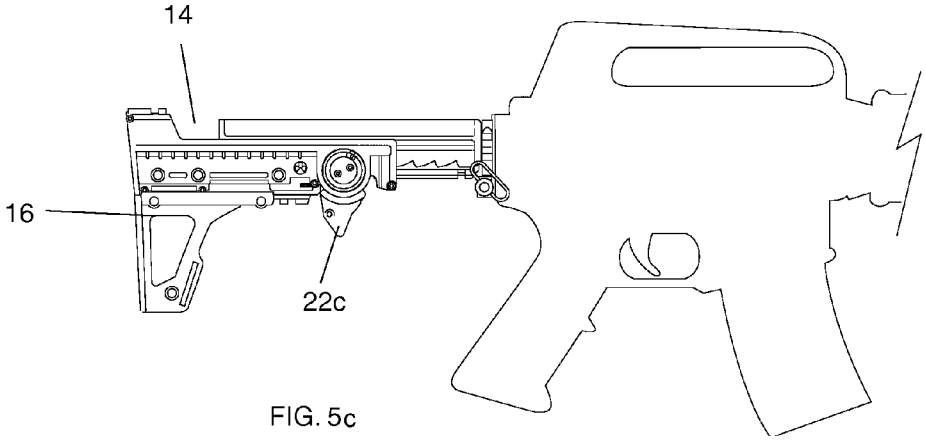

With reference now to the drawings, the preferred embodiment of the modular gunstock will be explained. With reference to FIGS. 1, 1*a*, 1*b*, 1*c*, the gunstock is composed of a modified buffer tube module 2 and a stock module 12. Buffer tube 2 fits on rifle 1 by replacing the existing buffer tube of the rifle with the buffer tube module 2. In addition, referencing FIGS. 3 and 4, rail track 8, with individual lateral grooves 6 and single transverse groove 7, is disposed towards the ground and cheek mount 10 is disposed upwards and is generally parallel to buffer tube 4. Two longitudinal tracks 9 are disposed slightly underneath cheek plate 10 providing attachment tracks for stock module 12. Ideally, the cheek plate 10 is fused onto the buffer tube 2. However, in alternative embodiments, enough space can be left between buffer tube 4 and cheek plate 10 to allow for unhindered motion of a cylindrical stock module. Tooth interfaces 5 are disposed underneath the longitudinal tracks 9.

Figure 6:
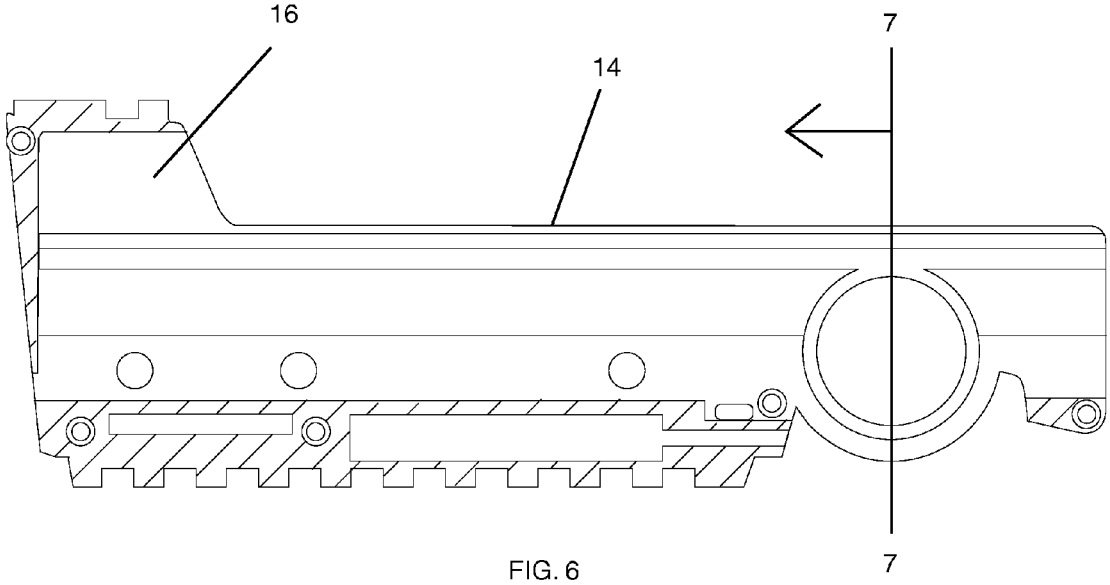
FIG. 6 is a side plan view of an adjustable stock module.
Figure 7:
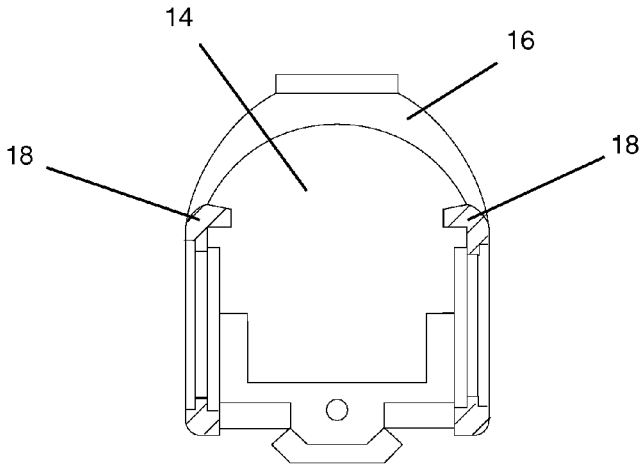
FIG. 7 is cross-section view of the module of FIG. 6, taken along line 7.

Referring to FIGS. 6 and 7, stock module 12 has a receiving cradle 14 that fits over buffer tube module 2. Two attachment rails 18 are disposed at the upper two edges of the cradle 14. Behind receiving cradle 14 is the butt 16 of the stock. Butt 16 may be modified in various configurations, depending on the needs of the user, shown in FIGS. 10 *a*–*e* and 11 *a*–*c*. In the adjustable embodiment shown in FIG. 1*a*, a latching mechanism interfaces with rail track 8 via a double cusped tooth 28 and cam mechanism, shown in detail in FIGS. *a*–12*c*. Latch switch 24 has three settings, shown in FIGS. 5*a*–5*c* and 12*a*–12*c*, which activate compression mechanism 26 to bias tooth 28 against tooth interface 5. As tooth 28 is further biased against interface 5, stock module 12 is locked into relative position against the buffer tube module 2. Tooth 28 has a forwards disposed angle 30, which, at the proper setting, allows for extension of the stock while prohibiting compression. In the locked setting, a cam anchor is biased into the rail track 8 in one of the lateral grooves 6, while tooth 28 is locked into a non-movable interface with tooth interface 5. This construction allows a three point locking system that gives more security and stability than the prior art single point locking systems. In FIGS. 5*a*–5*c* and 12*a*–12*c*, 22*a* depicts a locked setting; 22*b* depicts an extension only setting; and 22*c* depicts a free motion setting. In all embodiments, rails 18 are slid through tracks 9 for proper guidance and hold. In fixed stock configurations, such as FIGS. 1*b* and 1*c*, a latching mechanism may be employed or a pinning system may be utilized.

Figure 8:
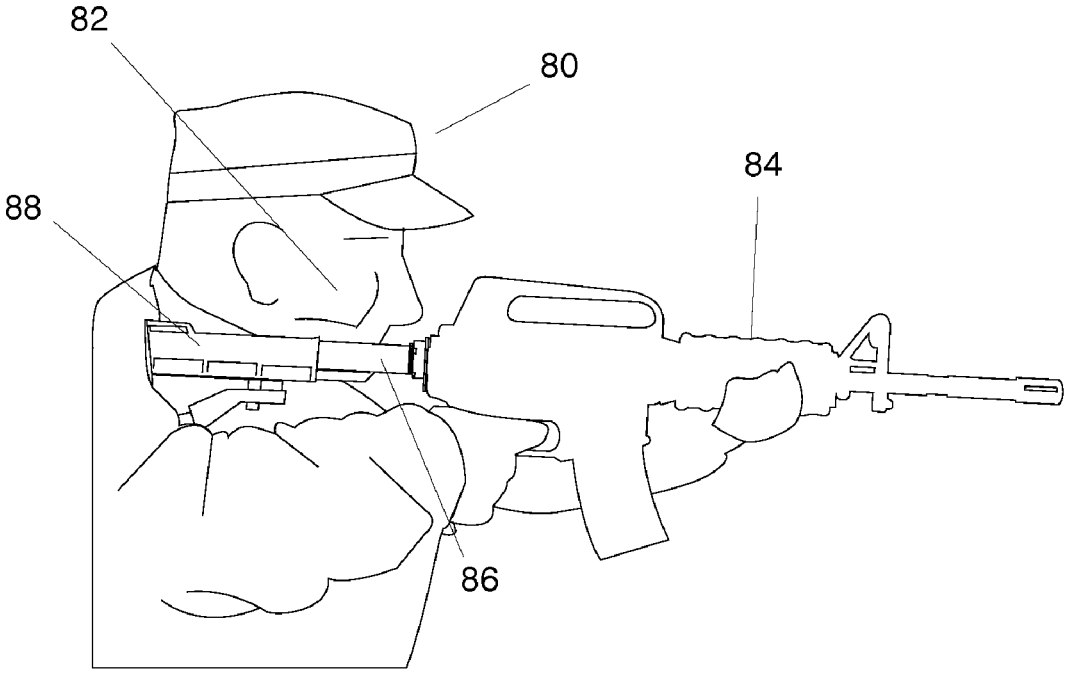
FIG. 8 is a side elevation depicting the use of the current standard adjustable stock.
Figure 9:
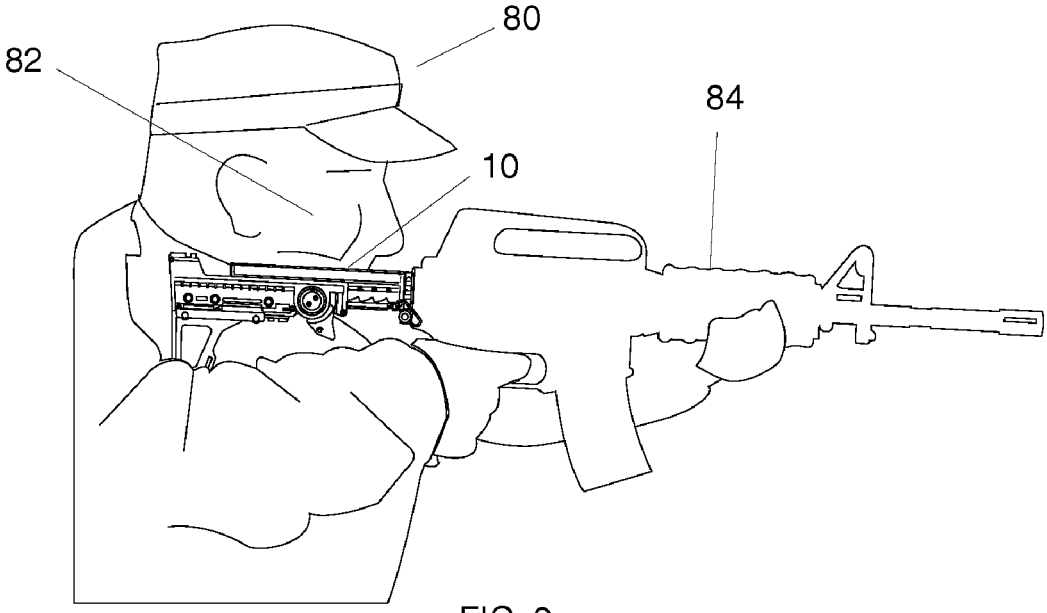
FIG. 9 is a side elevation depicting the use of the present invention with an adjustable stock module.

FIG. 8 shows the prior art adjustable stock configuration. Notice that user 80 places cheek 82 against the weapon 84. Cheek 82 is positioned against the juncture of the fore 86 and hind 88 portions of the stock. This not only causes discomfort but also interferes with the use of the weapon. FIG. 9 shows use of the present invention. User's cheek 82 is now placed against cheek plate 10, eliminating discomfort and minimizing disruption caused by placement at the juncture as in the prior art.

Figure 10A:
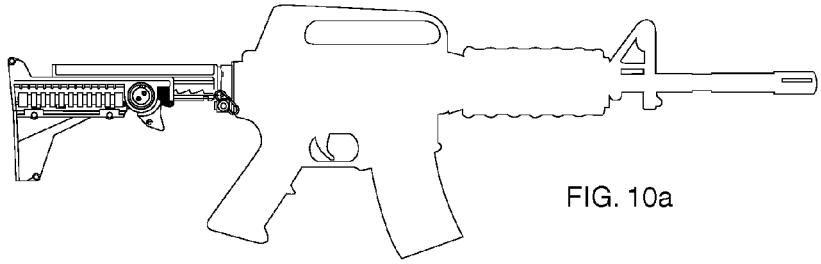
FIGS. 10*a* through 10*e* depict side elevations of suggested stock options.
Figure 10B:
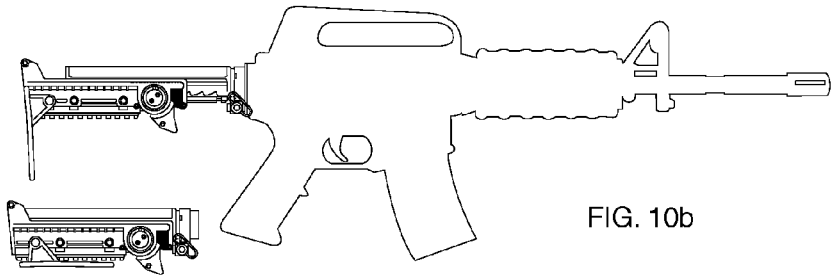
Figure 10C:
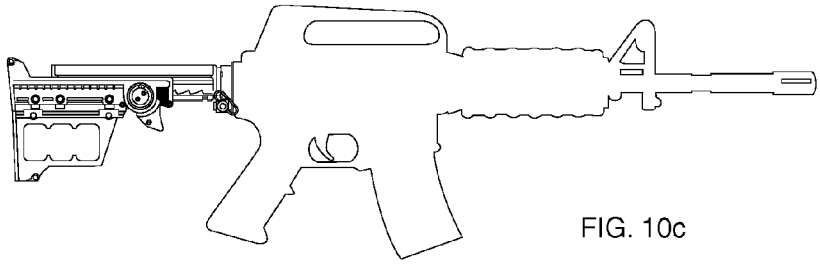
Figure 10D:
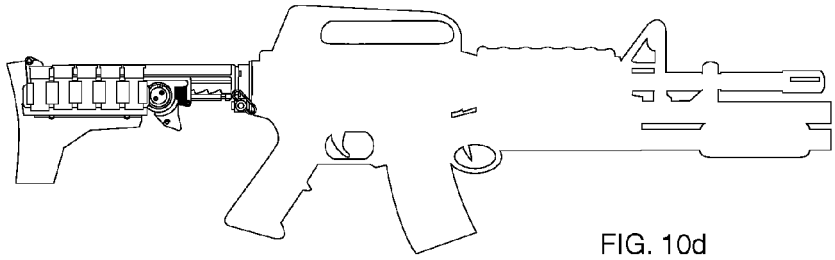
Figure 10E:
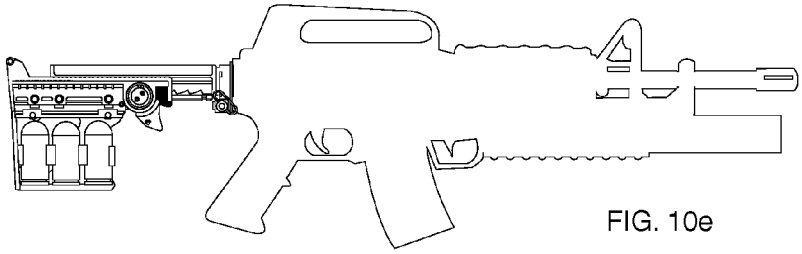
Figure 11A:
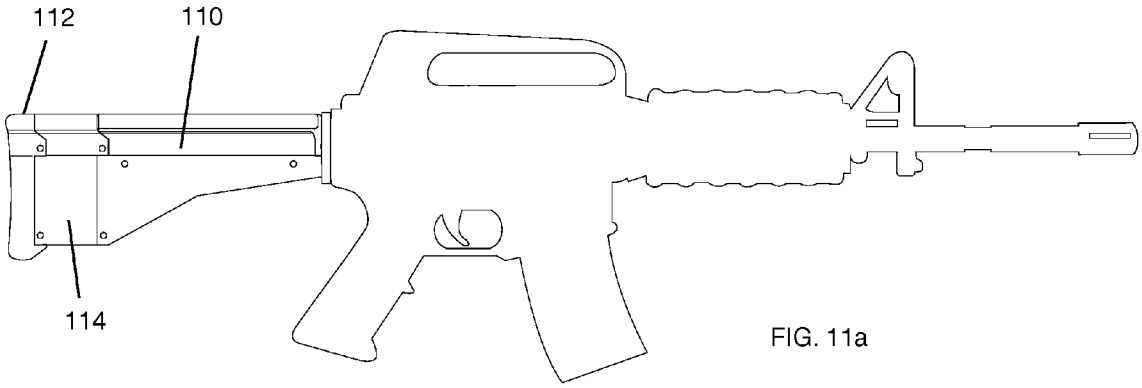
FIGS. 11*a* through 11*c* are side elevations of a specialized stock option that has further modularity.
Figure 11B:
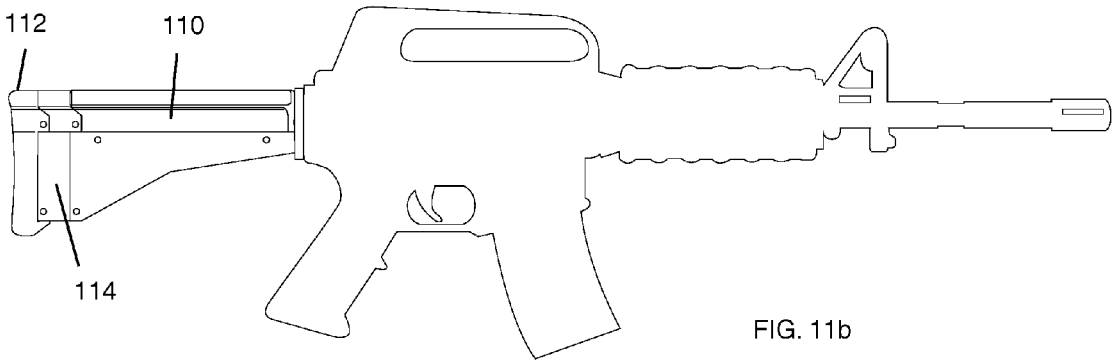
Figure 11C:
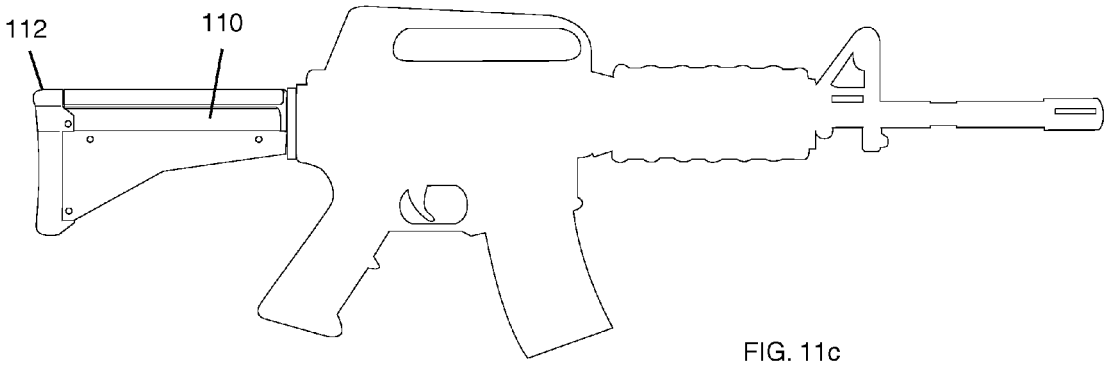
Figure 12A:
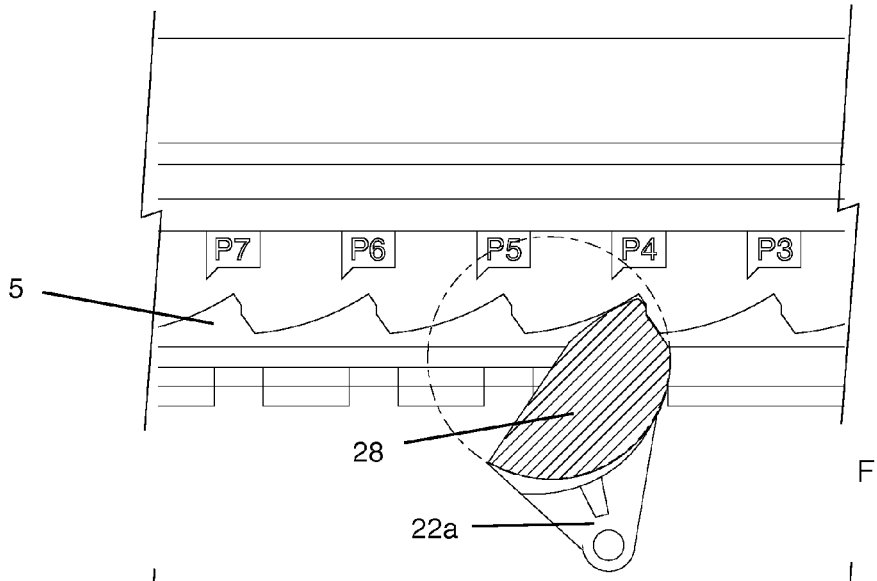
FIGS. 12*a*–12*c* are three successive partial sections detailing the latching system, corresponding to the adjustable stock shown in FIGS. 5*a*–5*c*.
Figure 12B:
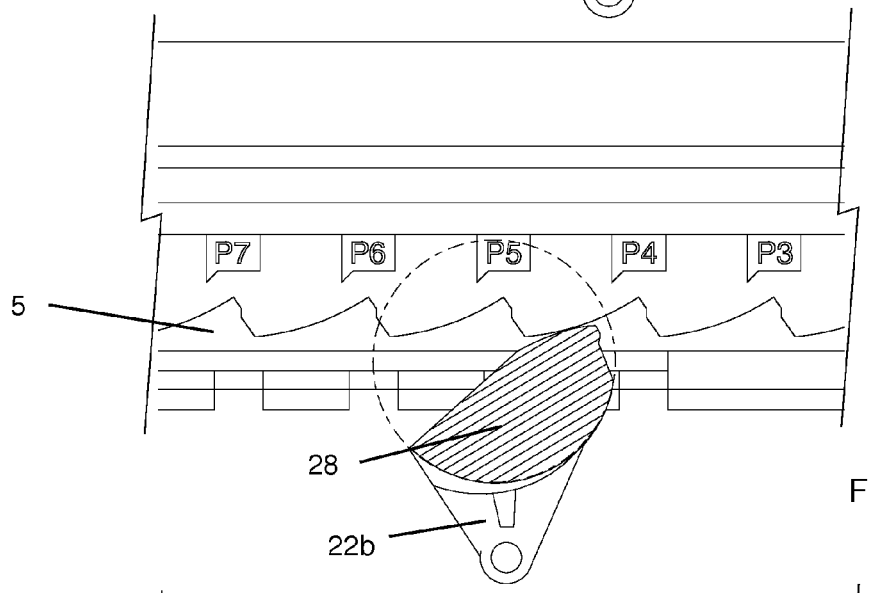
Figure 12C:
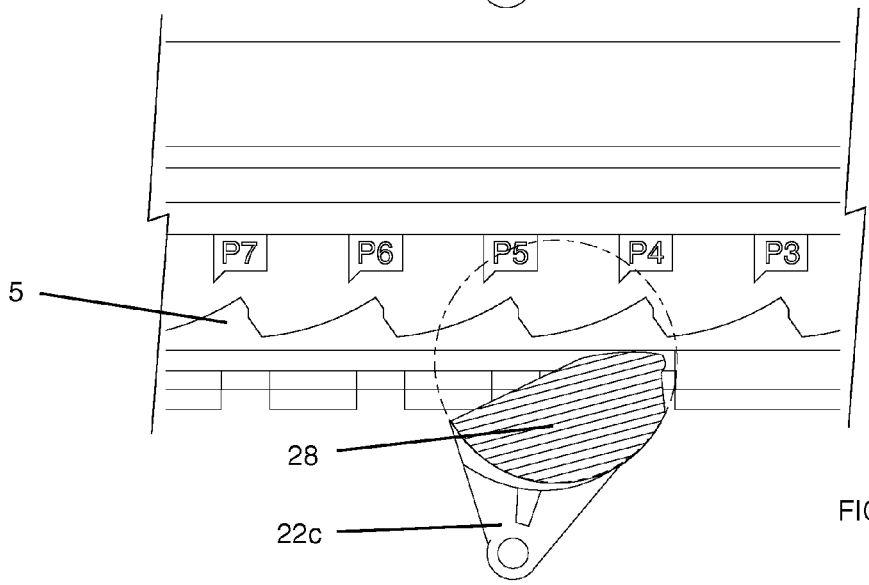

In keeping with the modularity of the present invention, numerous configurations of stock module 12 may be used for various uses. All of which are made to interface with the replacement buffer tube 4. Shown in FIGS. 10*a*–10*e* are five such configurations for adjustable stocks. FIG. 10*a* depicts a carbine stock; 10*b* a foldable stock; 10*c* an adjustable stock with a battery pack. FIGS. 10*d* and 10*e* depict mounting systems for ammunition for additional mounted weapon attachments. FIGS. 11*a*–11*c* displays a further modular fixed stock. Stock module 112 may be extended away from stock base 110 as needed for spacer 114. Spacer 114 may be a battery pack, a simple extension or anything a user desires. An additional side mounting rail systems may also be added to any stock module.

The present invention utilizes a compression, or "cam", latch with adjustable modules, shown in better detail in FIGS. 12 and in the parent application. It incorporates a latch body 22, divided in two halves, a safety latch attached to a spring mount with a safety tooth, and a bicuspid latch tooth 28 and an associated cam mechanism. Latch 20 is axially mounted about two mounting holes 34, one in each half, in a manner to interface with rail track 8 and tooth interfaces 5, shown in FIGS. 3 and 4. Latch 20 has three settings. Latch body 22 is pulled backwards to disengage latch tooth 28 from tooth interfaces 5. This setting allows free adjustment, forwards and backwards, of the module. Cam mechanism 26 operates to bias latch tooth 28 into a middle, ratcheting position. The latch tooth has a forwards-facing angle 30, which allows latch tooth 28 to catch the rail track if the stock module is pushed forwards, but disengages from tooth interfaces 5 for backwards extension. The final position is a locked position which forces latch tooth 28 into an almost vertical position. Cam anchor is also forced into rail track groove 6. Safety latch is forced to interface with the stock module with its safety tooth by spring mount. The interface prevents latch body 22 from being compressed accidentally. Spring mount is embedded into latch body 22 in such a manner that when safety latch is mounted upon it, safety latch is flush with latch body 22.

Figure 13:
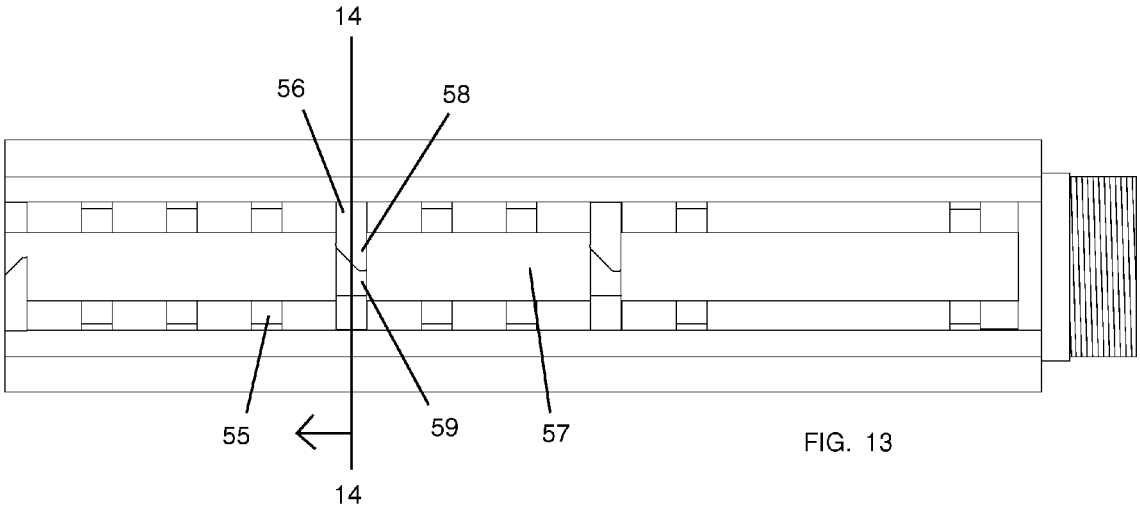
FIG. 13 is a bottom plan view of the buffer tube module and associated preset system.
Figure 14:
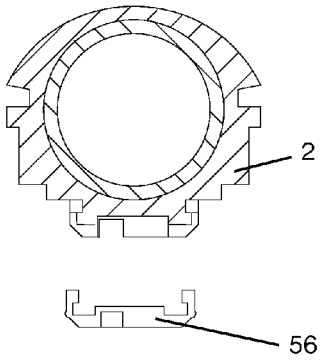
FIG. 14 is a cross section view of the buffer tube module of FIG. 13, with the preset clip removed, taken along line 14.
Figure 15:
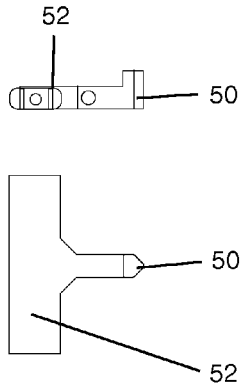
FIG. 15 is two close up views of the preset tooth

In an alternate embodiment, shown in FIGS. 13, 14, and 15, a catch tooth 50 is disposed above the latching mechanism to interface with transverse channel 57. Catch tooth 50 is mounted upon catch base 52, forming a shape reminiscent of a capital "T", and is biased by spring 54 into a central position. Stop bar 56 is a clip insertable into the lateral grooves 55 of transverse channel 57. Stop bar 56 has a groove 59 corresponding with transverse channel 57 except that groove 59 is almost dissected by projection 58, leaving enough room for tooth 50 to pass through if biased to one side. In so doing, a preset function is added to this embodiment. A user simply inserts a stop bar at a desired length. When extending the stock module, tooth 50 will be blocked by projection 58, thus arresting extension of the stock module. To pass the stop bar, the user presses stop base 52 to one side, allowing tooth 50 to pass. Spring 54 then returns tooth 50 to a central position when pressure is released. A second stop bar, possibly with projection 56 facing a different direction, may be added for further security. In addition, the back of the transverse groove 57 may be fashioned with such a projection to prevent the stock module from accidentally being pulled off the buffer tube module.

Although the present invention has been described with reference to preferred embodiments, numerous modifications and variations can be made and still the result will come within the scope of the invention. No limitation with respect to the specific embodiments disclosed herein is intended or should be inferred.

We claim:

1. A modular stock system for a rifle comprising:

a. a mounting module having upper and lower sides, the downward side being disposed towards the ground, said module having attachment means;

b. a replaceable stock module attachable on the mounting module: and c. a cheek plate essentially coaxial to the mounting module said cheek plate being raised in relation to the stock module such that the stock module is slideable both beneath and in relation to the cheek plate;

wherein the stock module is selectable from a group of assorted modules with varying designs adapted to different functions.

2. The modular stock system of claim 1, the cheek plate extending from a firearm receiver over the mounting and stock modules.

3. The modular stock system of claim 2, the stock module further comprising:

a. An interface to receive the mounting module;

b. At least one attachment means to secure the mounting module; and c. A stock portion, disposed in a rearward direction relative to the receiving interface.

4. The modular stock system of claim 1, the cheek plate extending from the mounting module and extending over any remainder of the mounting and stock modules.

5. The modular stock system of claim 4, the stock module further comprising:

a. An interface to receive the mounting module;

b. At least one attachment means to secure the mounting module; and c. A stock portion, disposed in a rearward direction relative to the receiving interface.

6. The modular stock system of claim 1, the stock module further comprising:

a. An interface to receive the mounting module;

b. At least one attachment means to secure the mounting module; and

A stock portion, disposed in a rearward direction relative to the receiving interface.

* * * * *